United States Patent [19]

Proud et al.

[11] Patent Number: 4,518,897

[45] Date of Patent: May 21, 1985

[54] TWIN ANODE BEAM MODE FLUORESCENT LAMP

[75] Inventors: Joseph M. Proud, Wellesley Hills; A. Bowman Budinger, Westford; Leslie A. Riseberg, Sudbury; Wojciech W. Byszewski, Arlington, all of Mass.

[73] Assignee: GTE Laboratories Incorporated, Waltham, Mass.

[21] Appl. No.: 336,971

[22] Filed: Jan. 4, 1982

[51] Int. Cl.[3] ..... H05B 41/16; H05B 41/24

[52] U.S. Cl. ..... 315/260; 313/306; 313/310; 313/350; 313/629; 313/632

[58] Field of Search ..... 313/306, 310, 350, 599, 313/629, 632; 315/56, 260, 334, 337, DIG. 1

[56] References Cited

U.S. PATENT DOCUMENTS

| | | | |
|---|---|---|---|
| 2,441,863 | 5/1948 | Zabel | 313/629 |
| 2,946,909 | 7/1960 | Morehead | 313/43 |
| 3,013,169 | 12/1961 | Gungle et al. | 313/43 |

*Primary Examiner*—William L. Sikes
*Assistant Examiner*—Robert E. Wise
*Attorney, Agent, or Firm*—J. Stephen Yeo

[57] ABSTRACT

The lamp shown herein is a beam mode fluorescent lamp for general lighting applications. The lamp comprises a light transmitting envelope, having a phosphor coating on its inner surface, enclosing a thermionic cathode for emitting electrons, a pair of anodes for accelerating the electrons and forming electron beams, and a fill material, such as mercury, which emits ultraviolet radiation upon excitation. The two anode configuration provides an extended region of electron beam excitation. In addition, a separate cathode heater filament is not required due to the anode configuration. As a result this lamp is operated with a single power source and only two conductors connecting the power source to the electrodes. This invention further provides a high degree of self-stabilization of discharge current by means of the twin parallel anode configuration.

10 Claims, 5 Drawing Figures

TWIN ANODE BEAM MODE FLUORESCENT LAMP

CROSS REFERENCE TO RELATED APPLICATIONS

The present invention is an improvement to copending U.S. patent application Ser. No. 219,564, now abandoned, filed on Dec. 23, 1980, for a "Beam Mode Fluorescent Lamp", assigned to the same asignee. The present invention is also related to pending U.S. patent application Ser. No. 337,047; allowed application Ser. No. 337,048 allowed application Ser. No. 336,794; and U.S. Pat. Nos. 4,413,204 and 4,408,141, all assigned to the same assignee.

BACKGROUND OF THE INVENTION (1) Field of the Invention

The present invention pertains to beam mode discharge fluorescent lamps and more particularly to an arrangement for configuring the electrodes within a beam mode discharge fluorescent lamp.

(2) Description of the Prior Art

U.S. patent application Ser. No. 219,564, now abandoned, filed on Dec. 23, 1980, for a "Beam Mode Fluorescent Lamp", and assigned to the same assignee as the present invention, discloses a particular embodiment of a fluorescent lamp suitable for replacing the conventional incandescent bulb. Although incandescent lamps are inexpensive and convenient to use, they are considerably less efficient than fluorescent lamps.

In the above mentioned patent application, a single anode and cathode configuration is shown. This configuration requires three power terminals connecting the cathode and anode to the two power sources. In an alternate configuration in this application, a four terminal and two power source configuration is shown in which a heating filament is provided to heat the cathode for the production of electrons.

It is desirable to minimize the number of power sources and connections from the power source to the anode and cathode of the fluorescent lamp. Such a scheme provides for simpler assembly during manufacture and lowered cost.

As pointed out in the above mentioned patent application, the placement and location of the anode and cathode is of critical importance.

SUMMARY OF THE INVENTION

Accordingly, it is an object of the present invention to provide a beam mode fluorescent lamp in which the number of power sources and of power terminals is minimized.

It is a further object of the present invention to provide a beam mode fluorescent lamp which provides for an extended region of electron excitation.

It is another object of the present invention to provide said beam mode fluorescent lamp in which there is a high degree of self-stablization of the discharge current.

The subject beam mode fluorescent lamp includes a light transmitting envelope enclosing a fill material, which emits ultraviolet radiation upon excitation. A phosphor coating on an inner surface of the envelope emits visible light upon absorption of ultraviolet radiation.

A thermionic cathode for emitting electrons is located within the envelope. The cathode is connected to a single power source by two conductors, one conductor connected to each end of the cathode. These same conductors also serve to support the cathode at a stationary location within said envelope.

Twin anodes are employed for accelerating electrons and forming twin corresponding electron beams in response to a voltage applied to the cathode. One of said twin anodes is connected to a first end of the cathode and disposed over the cathode at an upward angle with respect to the cathode. The second anode is connected to the second end of said cathode and disposed under the cathode at a downward angle with respect to said cathode and parallel with respect to the first anode. Each anode is spaced apart from the cathode by a distance which preferably is less than the electron range in the fill material. The structure of each anode permits acceleration of the corresponding electron beam with minimum collection of primary electrons by the anode.

The fluorescent lamp includes two drift regions within the envelope through which the electron beams drift after passing their respective anodes. Electrons in each electron beam collide with atoms of the fill material in the corresponding drift region, thereby causing excitation of a portion of the fill material atoms and emission of ultraviolet radiation and causing ionization of another portion of the fill material atoms and emission of secondary electrons. These secondary electrons cause further emissions of ultraviolet radiation. The fill material typically includes mercury and a noble gas.

The potential drop between the first and second ends of the cathode provides a potential difference between each of the anodes and all points along the cathode except, the end that connects it to the respective anode. For applications of AC voltage during one-half of the cycle, the first anode will be positive with respect to all points along the cathode except, the end to which it is connected. This condition will accelerate electrons from the cathode to and past the anode and into the drift region. During the other half of the AC cycle, the second anode will be positive with respect to all points on the cathode except, the end to which it is connected. This will cause a second beam of electrons to be accelerated in the opposite direction. This second electron beam will also pass the second anode entering the second drift region.

Various shapes of anodes may be employed in constructing the present invention, however the anodes must not be constructed so as to prevent many primary electrons from passing to the drift region. The following anode shapes are recommended but such shapes are not limited to: single wires, planar rectangular wire loops, planar rectangular wire meshes, and slightly curved wire meshes.

DESCRIPTION OF THE PREFERRED EMBODIMENT

Figure 1:
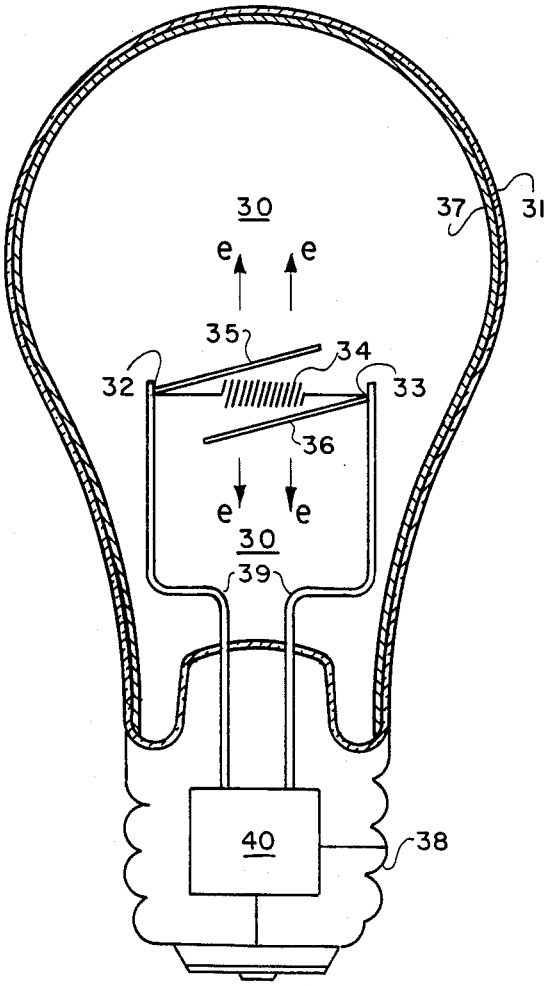
FIG. 1 is a schematic diagram of a beam mode fluorescent lamp embodying the present invention.

Referring to FIG. 1, a beam mode fluorescent lamp according to the present invention is shown. A vacuum type lamp envelope 31 made of a light transmitting substance, such as glass, encloses a discharge volume.

The discharge volume contains a fill material which emits ultraviolet radiation upon excitation. A typical fill material includes mercury and a noble gas or mixtures of noble gases. One such noble gas is neon. The inner surface of the lamp envelope 31 has a phosphor coating 37 which emits visible light upon absorption of ultraviolet radiation. Also enclosed within the discharge volume by the lamp envelope 31, are a cathode 34 and a pair of anodes 35 and 36. The anodes 35 and 36 may have various configurations as described below.

In general, the function of the cathode 34 is to emit electrons, while the function of the anodes 35 and 36 is to accelerate the electrons emitted by cathode 34, while collecting only a minimal amount of primary electrons. Anode 35 is connected to the end 32 of cathode 34 and extends outwardly and upwardly at an angle with respect to cathode 34. Anode 36 is connected to the other end 33 of anode 34 and extends at an angle downwardly and parallel to anode 35. In the description and claims the directions up, down, horizontal, and vertical are only for the purpose of explanation since the lamp will operate in any orientation provided that the structural relationships are maintained.

Supporting conductors 39 provide for electrical connection of the single external power supply 40 through the envelope 31 in a vacuum tight seal, as well as providing support for the cathode 34 and the anodes 35 and 36. Cathode 34 is typically of a 15 to 30 volt thermionic type.

When the electrons have passed anodes 35 and 36 they enter into twin drift regions 30 which extend from the anode to the bounds of the enclosing envelope 31. The lamp further includes a base 38 which is of a conventional type suitable for inserting into an incandescent lamp socket.

During operation, a voltage is applied via conductors 39 to thermionic cathode 34, thereby providing for a readily available supply of electrons for discharge. During the first half of the AC signal, point 32 is positive with respect to point 33 of cathode 34. As a result, a potential drop exists between points 32 and 33. Anode 35 will accelerate electrons from cathode 34, since anode 35 is positive with respect to all points along the cathode 34 with the exception of point 32. Most electrons will then pass through the anode and into the corresponding drift region 30 as shown. During the alternate half of the AC voltage, point 33 will be positive with respect to point 32 and anode 36 will accelerate electrons in a downward direction into the lower drift region 30 as shown. Each of the drift regions preferably has a dimension in the direction of travel of the respective electron beam which is greater than the electron range in the fill material so that the primary electrons in each of said electron beams collide with and ionized and excite some of the atoms of the fill material in the respective drift region. The excited atoms emit ultraviolet radiation. The secondary electrons collide with and excite other atoms to emit additional ultraviolet radiation.

It is to be noted that the cathode heating current and current for developing potential difference between anode and cathode are derived from the same power source 40 preferably contained within base 20. Only a single power source and pair of leads are required for the two functions. As a result, maximum heating of cathode 34 is accomplished since the discharge current does not begin instantly. Thereby minimum time is required for the discharge to begin. The parallel connection of discharge current and heating current paths provides a stabilizing effect such that increased discharge current reduces the current flow through the cathode. Power source 40 comprises a step-down transformer, which lowers the output voltage to approximately 15 to 30 volts.

Further, as a result of the angular displacement of anode 35 and 36 with respect to cathode 34, the average electric field produced between each anode and the cathode 34 will be uniform and will act to equalize the electron flux at all points along the cathode. As a result, a higher operating efficiency is realized.

As shown in FIG. 1, two regions of electron beam excitation are produced, one by anode 35 and the other by anode 36. As a result, lamp 31 may be generally larger than a lamp having only a single anode and may contain a rare gas at a somewhat higher pressure. These factors substantially increase the efficiency of the discharge lamp.

The spacing of anodes 35 and 36 with respect to cathode 34 may be such that it is less than the electron range in the particular fill material to avoid possible current runaway conditions.

Figure 2A:
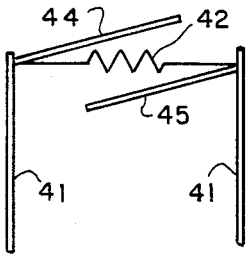
FIGS. 2A, 2B, 2C, and 2D illustrate various anode configurations which may be employed in realizing the beam mode fluorescent lamp of the present invention.
Figure 2B:
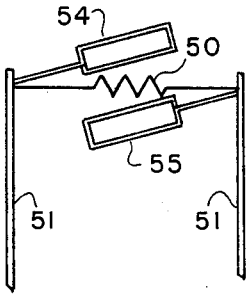
Figure 2C:
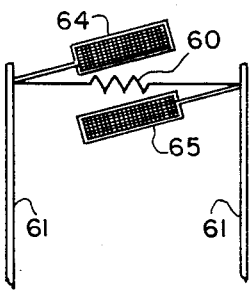
Figure 2D:
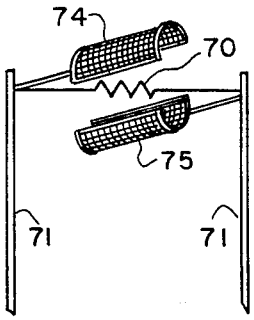

Referring now to FIGS. 2A through 2D, various anode configurations are depicted for use in the present beam mode fluorescent lamp. In all the configurations, one anode is connected at each end of the cathode and disposed parallel to the other anode. FIG. 2A illustrates two round wire anodes 44 and 45, disposed about cathode 42, all supported by conductors 41. FIG. 2B illustrates anodes 54 and 55 shaped in planar wire rectangular loops. Anodes depicted in FIGS. 2A and 2B have been rotated 90° from their desired position to show their shape more clearly. FIG. 2C illustrates anodes 64 and 65 in the shape of a planar rectangular wire mesh. FIG. 2D illustrates anodes 74 and 75 in the shape of a slightly radiused domed rectangular wire mesh. All of the above configurations are suitable for use in the present invention, although the present invention need not necessarily be limited to these particular configurations.

Although a preferred embodiment of the invention has been illustrated, and that form described in detail, it will be readily apparent to those skilled in the art that various modifications may be made therein, without departing from the spirit of the invention or from the scope of the appended claims.

What is claimed is:

1. A beam mode fluorescent lamp comprising:

a light transmitting envelope enclosing a fill material which emits ultraviolet radiation upon excitation;

a phosphor coating, which emits visible light upon absorption of ultraviolet radiation, on an inner surface of said envelope;

a thermionic cathode having proper resistance located within said envelope for emitting electrons, said cathode having first and second ends;

a first and a second anode, each of said anodes located within said envelope for accelerating electrons and alternately forming corresponding first and second electron beams in response to a voltage applied between said anodes and said cathode, each of said anodes being spaced apart from said cathode by a distance which is preferably less than the electron range in said fill material and having a structure which permits said electron beams to pass therethrough;

said first anode being connected to said first end of said cathode and disposed at an upward angle with respect to said cathode and said second anode being connected to said second end of said cathode and disposed at a downward angle with respect to said cathode and parallel to said first anode;

first and second drift regions, each located within said envelope through which said first and said second electron beams drift after passing through said first and said second anodes respectively, each of said drift regions having a dimension in the direction of travel of said respective electron beam which is greater than the electron range in said fill material, so that the electrons in each of said electron beams collide with the atoms of said fill material in said respective drift region, thereby causing excitation of a portion of said fill material atoms and emission of ultraviolet radiation and causing ionization of another portion of said fill material atoms and emission of secondary electrons, said secondary electrons causing emission of additional ultraviolet radiation;

a power source external to said envelope; and means for connecting said cathode and each of said anodes to said power source.

2. A beam mode fluorescent lamp as claimed in claim 1, wherein said fill material includes mercury and at least one noble gas.

3. A beam mode fluorescent lamp as claimed in claim 2, wherein said noble gas includes neon.

4. A beam mode fluorescent lamp as defined in claim 1, wherein each of said first and second anodes is in the form of a linear conductive wire segment.

5. A beam mode fluorescent lamp as claimed in claim 1, wherein each of said first and second anodes is in the form of a planar rectangular conductive wire mesh.

6. A beam mode fluorescent lamp as claimed in claim 1, wherein each of said first and second anodes is in the form of a planar rectangular conductive wire loop.

7. A beam mode fluorescent lamp as claimed in claim 1, wherein each of said first and second anodes is in the form of a radiused rectangular conductive wire mesh.

8. A beam mode fluorescent lamp as claimed in claim 1, wherein there is further included a lamp base enclosing said power source, whereby said lamp can be operated directly from AC power.

9. A beam mode fluorescent lamp as claimed in claim 8, wherein said power source provides power for heating said thermionic cathode and simultaneously for providing a potential difference between said cathode and said first and second anodes.

10. A beam mode fluorescent lamp as claimed in claim 9, wherein said power source provides an AC voltage in the range of from 15 to 30 volts.

* * * * *